United States Patent [19]

Lesh et al.

[11] 3,964,642

[45] June 22, 1976

[54] MINI CADDY

[76] Inventors: Robert C. Lesh, c/o George Spector, 3615 Woolworth Bldg., 233 Broadway; George Spector, 3615 Woolworth Bldg., 233 Broadway, both of New York, N.Y. 10007

[22] Filed: June 30, 1975

[21] Appl. No.: 591,483

[52] U.S. Cl. ..... 222/142.4
[51] Int. Cl.[2] ..... B47G 19/12
[58] Field of Search ..... 222/142.1–142.9

[56] References Cited

UNITED STATES PATENTS 1,224,699 5/1917 Arolan ..... 222/142.4
2,459,133 1/1949 Nyberg ..... 222/142.2

*Primary Examiner*—Allen N. Knowles
*Assistant Examiner*—Hadd S. Lane

[57] ABSTRACT

A novel salt and pepper shaker that can be conveniently carried in a person's pocket or purse so to always be handy when eating away from home; the device consisting of a fountain-penshaped assembly comprised of two cylindrical cases screwed together at their ends one of which contains salt and the other contains pepper, and the outer ends of the cases being perforated so the content can be shaken out.

2 Claims, 4 Drawing Figures

Fig. 1
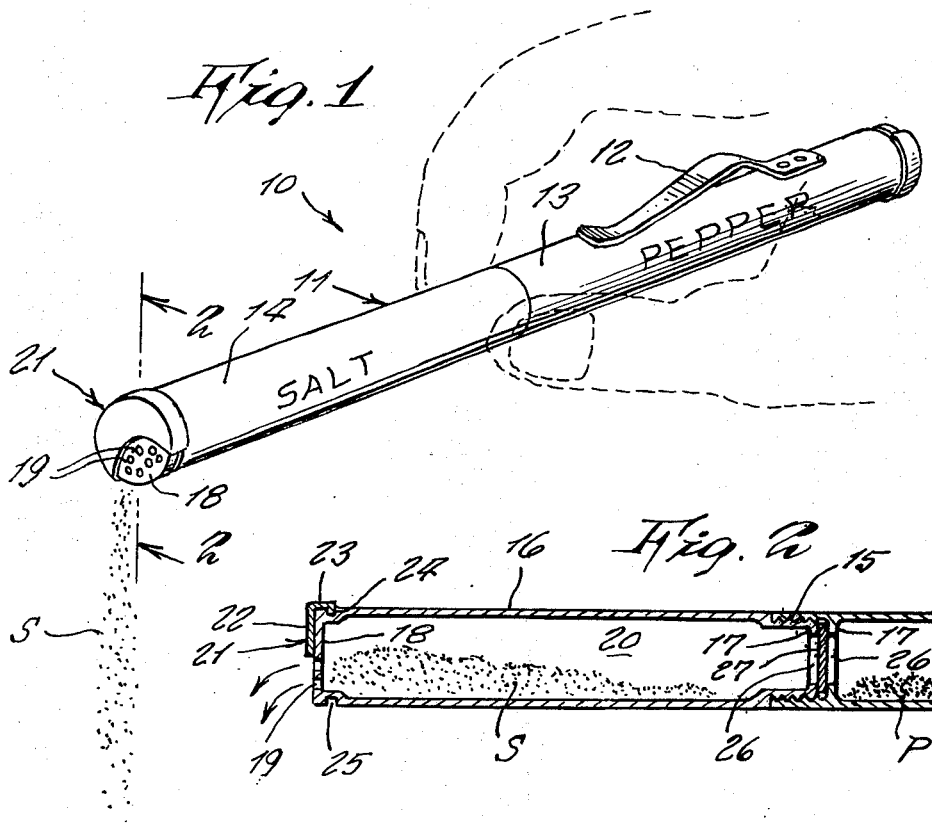
Fig. 2
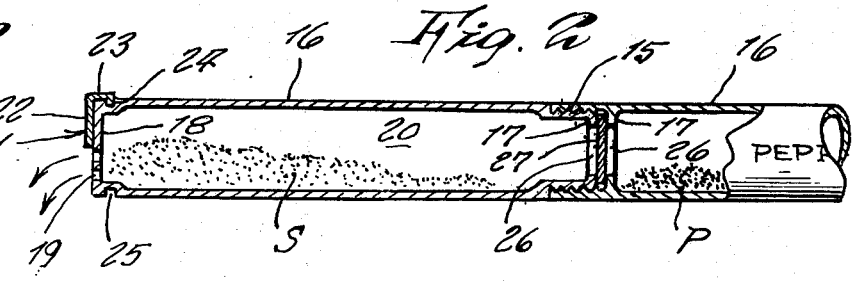
Fig. 3
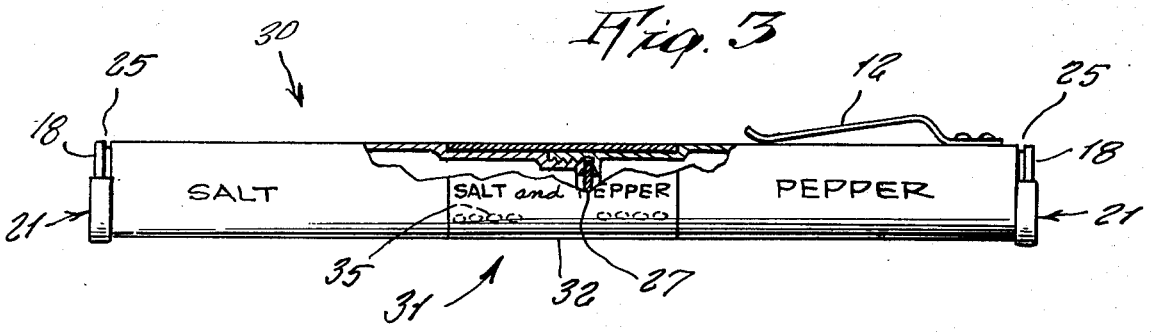
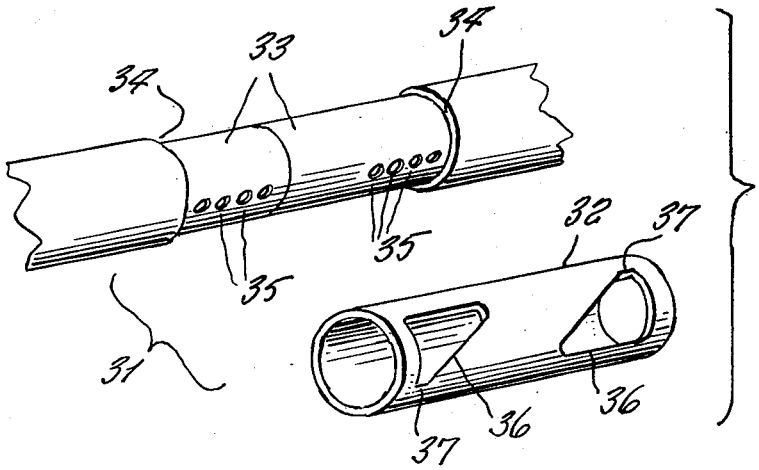
Fig. 4

MINI CADDY

This invention relates generally to salt and pepper shakers.

A principal object of the present invention is to provide a salt and pepper shaker set which is in the shape of a fountain pen and which has a clip so that it can be readily carried in a pocket or purse so to be always available when needed, such as on a picnic, eating while traveling in a car or other vehicle or while taking a snack in a motel or hotel room.

Another object is to provide a mini caddy salt and pepper shaker set dispense salt from one end and pepper from its other end, wherein, in a modified design of the invention both salt and pepper are dispensed at a same time and in any selected proportions from a center part of the device.

Other objects are to provide a mini caddy which is simple in design, inexpensive to manufacture, rugged in construction, easy to use and efficient in operation.

These and other objects will be readily evident upon a study of the following specification and the accompanying drawing wherein:

FIG. 1 is a perspective view of the invention.

FIG. 2 is a cross section on line 2—2 of FIG. 1.

FIG. 3 is a side view partly in cross section of a modified design of the invention which includes a rotatable barrel around the middle so to permit both salt and pepper to be shaken out at a same time.

FIG. 4 is a detail of structure shown in FIG. 3 and which shows a means whereby either more salt or more pepper can be dispensed by simple rotating the barrel so that a greater or lesser amount of salt or pepper dispensing holes are exposed for dispensing, thus giving complete versatility to the device.

Referring now to the drawing in greater detail, and more particularly to FIGS. 1 and 2 thereof at this time, the reference numeral 10 represents a mini caddy according to the present invention wherein there is a cylindrical shaped body 11 which is approximately the length and diameter of a conventional fountain pen so that it comfortably fits in a garment pocket, and which also includes a clip 12 along its side in order to clip over the edge of the pocket so to prevent it accidently to fall out therefrom.

The body 11 is comprised of two same diameter, cylindrical shaped cases 13 and 14 which are detachably attached together at their one ends, by means of a interconnecting screw threads 15. Each case includes a cylindrical side wall 16, an end wall 17 adjacent the screw threaded end, and an opposite end wall 18 at its other end, the end wall 18 having a portion thereof provided with perforated openings 19 through which the salt or pepper may be outwardly dispensed from a central chamber 20 of the case. A rotatable end cap 21 has an end wall 22 that only partially covers the end wall 18 so to selectively expose the openings 19 or else to seal the same and prevent the dispensing operation. The end cap has a flange 23 that fits around the side wall 16 and which has an inward extending bead 24 the slides within annular groove 25 of the case, thus preventing the cap to come off the case while being permitted to rotate.

In order that the chambers may be filled either with salt S or pepper P, a large opening 26 is provided through the end wall 17. A circular solid disc 27 is abutted between the end walls 17 of the two cases so to prevent the salt in one case and pepper in the other case from mixing together or getting into each other's cases.

To refill the cases, the cases are accordingly first unscrewed and the disc removed thus exposing the refill openings 26 of each case. To dispense either the salt or pepper, the end cap 21 is rotated so to expose the dispensing openings 19, and the device is held as shown in FIG. 1 so to dispense the selected seasoning upon a food.

In FIGS. 3 and 4, a modified design of mini-caddy 30 is shown that is the same in all the features of mini caddy 10 except that it additionally includes a dispensing mechanism 31 located at the junction of the two cases so that both salt and pepper may be dispensed at a same time from this portion of the device.

The mechanism 31 includes a sleeve-like, rotatable barrel 32 fitted around reduced diameter portions 33 at the end of each case, so that the barrel fits between the shoulders 34 thus formed and the outer cylindrical surface of the barrel is flush with the outer surface of the cylindrical side walls 16. Each diametrically reduced portion 33 has a row of perforated openings 35 that communicate with the chamber interior, and the barrel 32 has a pair of triangular openings 36 each one of which is aligned with one of the row of openings 35.

As clearly shown in the drawing, each triangular opening 36 is wide enough at one end so to align with all the openings 35 in the row, while the opening 36 tapers gradually in width toward its other end so that it aligns with less and less openings 35 until the triangular opening apex 37 aligns with only a single one of the openings 35. It is thus evident that by rotating the barrel, more or less of the openings 35 are exposed for dispensing.

It is also to be noted that the openings 36 taper in opposite directions to each other while the openings 36 are aligned with each other along the side wall of the barrel so that, at any one time as the barrel is rotated, it can expose a greater number of openings 35 on one case while it exposes a lesser number thereof on the other case. Thus, complete adjustability of dispensing proportions are possible to accomplish.

Thus a modified design is provided.

While various changes may be made in the detail construction. it is understood that such changes will be within the spirit and scope of the present invention, as is defined by the appended claims.

What is claimed is:

1. In a mini caddy, the combination of a body comprised of two cylindrical cases detachably screwed together at their one ends, each said end having a large refilling opening therethrough, a solid disc between said ends to separate the content of one case from the content of the other, an opposite end of each said case having an end wall a portion of which has perforated openings for dispensing said content, and a rotatable end cap adjacent said case end wall, said end cap partly covering said case end wall so to selectively expose or close said dispensing perforated openings.

2. The combination as set forth in claim 1 wherein a simultaneously dispensing mechanism for both said cases comprises diametrically reduced portions at said screwed together ends of said cases, a single row of openings on each said diametrically reduced portion, said rows being aligned, and a rotatable barrel filled around said diameterically reduced portion, a pair of triangular shaped openings aligned along a side of said barrel, said triangular openings each aligning said row of openings on one said case, and said triangular opening being tapered in opposite directions toward their apexes.

* * * * *